US006568367B2

(12) United States Patent
Rodier

(10) Patent No.: US 6,568,367 B2
(45) Date of Patent: May 27, 2003

(54) ENGINE COMPRESSION RELEASE BRAKE SYSTEM AND METHOD OF OPERATION

(75) Inventor: William J. Rodier, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/919,305

(22) Filed: Jul. 31, 2001

(65) Prior Publication Data

US 2003/0024500 A1 Feb. 6, 2003

(51) Int. Cl.[7] ..... F02D 13/04
(52) U.S. Cl. ..... 123/321; 123/90.12
(58) Field of Search ..... 123/321, 90.12, 123/90.15, 320, 322, 90.11

(56) References Cited

U.S. PATENT DOCUMENTS

| | | | | |
|---|---|---|---|---|
| 4,741,307 A | | 5/1988 | Meneely | |
| 5,012,778 A | | 5/1991 | Pitzi | |
| 5,357,926 A | | 10/1994 | Hu | |
| 5,479,890 A | * | 1/1996 | Hu et al. | 123/322 |
| 5,647,318 A | * | 7/1997 | Feucht et al. | 123/321 |
| 5,733,219 A | | 3/1998 | Rettig et al. | |
| 5,967,115 A | * | 10/1999 | Konopka et al. | 123/322 |
| 6,170,474 B1 | * | 1/2001 | Israel | 123/322 |
| 6,216,668 B1 | * | 4/2001 | Haugen | 123/320 |
| 6,283,090 B1 | * | 9/2001 | Harmon | 123/321 |
| 2002/0056435 A1 | * | 5/2002 | Yang et al. | 123/321 |

FOREIGN PATENT DOCUMENTS

JP 77075 * 3/1995 ..... F02D/13/04

OTHER PUBLICATIONS

U.S. application Ser. No. 09/441,854, Harmon, filed Nov. 17, 1999.
U.S. application Ser. No. 09/742,730, Leman et al., filed Dec. 20, 2000.

* cited by examiner

*Primary Examiner*—Willis R. Wolfe
*Assistant Examiner*—Hai H. Huynh
(74) *Attorney, Agent, or Firm*—Mike R Huber

(57) ABSTRACT

An electronic control unit varies the braking power level of a compression release brake system for an internal combustion engine in response to a signal based upon a machine's operating conditions. A sensor senses the operating conditions, generates a signal in response to the sensed condition and delivers the signal to the electronic control unit. The sensor can sense a variety of operating conditions including, speed, load, terrain grade, and requested brake power by a machine operator.

8 Claims, 3 Drawing Sheets

ENGINE COMPRESSION RELEASE BRAKE SYSTEM AND METHOD OF OPERATION

TECHNICAL FIELD

This invention relates to a compression release braking system and method for an internal combustion engine and more particularly to a compression release braking system and method that adjusts braking power in response to a sensed operating condition.

BACKGROUND ART

Engine compression release brakes are well known for providing retarding of vehicles without activation of the vehicle's service brakes. Compression release brakes are well known in the art. In general, traditional engine compression release brakes provide retarding by absorbing energy as a result of compressing intake air in the engine's combustion chamber. The engine's exhaust valves are opened near the end of the normal compression stroke, thereby preventing energy from being inputed back into the drive train. When the exhaust valves are opened, the pressure in the engine cylinder is released or "blown down", which produces a high level of noise emissions through the engine exhaust system.

Compression release brake systems are routinely used on over-the-road or on-highway vehicles, such as delivery truck and semi-tractors that regularly operate in both rural and urban regions. Many jurisdictions have instituted noise level restrictions, especially in residential areas, and traditional compression release brake systems typically produce noise levels that exceed the maximum noise levels permitted by law in many geographic regions. Consequently, vehicle operators are routinely prohibited from operating compression release brakes when operating in noise restricted regions. As a result, the operator must utilize the vehicle's services brakes to retard or slow the vehicle in cases where a compression release brake could be advantageously used to avoid wear on the service brakes.

Commercially available engine compression release brakes, such as those from Jacobs Manufacturing Company, are able to modulate the applied retarding force by selectively operating brake cycles on less than all of the engine cylinders. For example, in a six cylinder engine, brake systems are typically installed such that one portion of the brake system controls braking on one of the cylinders, another portion of the brake system controls braking on two cylinder together, and a third portion of the system controls braking on the remaining three cylinders. As a result, the vehicle operator can select among six discrete levels of braking by activating one to six of the cylinders. However, such modulation of the brake systems does not significantly alter the noise emission level produced by brake operation, but instead only changes the frequency of noise emissions and/or the cadence the noise emissions. This is due to the fact that resulting noise emissions correspond to the cylinder pressure at the time of pressure release, which is in turn tied to the timing of the pressure release event, which is in turn tied to the fixed shape of the cam that operates a traditional compression release brake. Although de minimis noise reduction may be achieved in traditional systems because lower braking levels produce lower turbo boost and thereby reduce cylinder pressure at the time of release, significantly reduced levels of noise emissions are not achievable in traditional systems even when operating at lower levels of braking or retarding.

In another attempt to reduce noise, the vehicle operator electrically adjusts the "lash" of the engine brake. "Lash" is the "at rest" clearance between the engine brake slave piston and the engine exhaust valve mechanism operated on by the slave piston to produce braking. By reducing the "lash", the timing of the braking event is advanced slightly, thereby reducing the cylinder pressure at "blow down." Unfortunately, this approach is not automatic and requires that the driver recognizes being in a noise restricted area and manually change the lash. Additionally, this design only provides one level of adjustment, even though jurisdictions may have varying degrees of noise restrictions. This system also increases the number of components in the vehicle and increases cost. Finally, because the "lash" is manually changed, the braking system is not capable of automatically providing additional braking power in an emergency, when it would otherwise be desirable to "ignore" noise restrictions for overriding safety concerns.

In commonly owned U.S. Pat. No. 5,733,219 to Rettig Et Al., the compression release brake system is enabled or disabled based upon vehicle speed. Although this is a beneficial feature of the braking system, improvement can be had by automatically adjusting braking power.

The prior art does not attempt to control braking noise or power based upon existing vehicle needs. Controlling the amount of braking based upon the vehicle needs would provide more consistent and safer vehicle operation. Further, even if noise restrictions did not exist, it would still be desirable to control the noise of the braking system.

This invention is directed to overcoming one or more of the problems identified above.

DISCLOSURE OF THE INVENTION

In one aspect of the present invention, a method for operating a machine with an engine compression release brake comprises the steps of: sensing an operating condition, generating a signal in response to the operating condition, delivering the signal, receiving the signal, and adjusting the compression release brake's braking power level between a minimum level and a maximum level in response to the sensed operating condition.

In another aspect of the present invention, an engine compression release brake system comprises: an engine compression release brake, a sensor to sense an operating condition and generate a signal in response to the sensed operating condition, and an electronic control module to receive the operating condition signal and control the braking power level of the engine compression release brake between a minimum level and a maximum level in response to the operating condition signal.

BEST MODE FOR CARRYING OUT THE INVENTION

Figure 1:
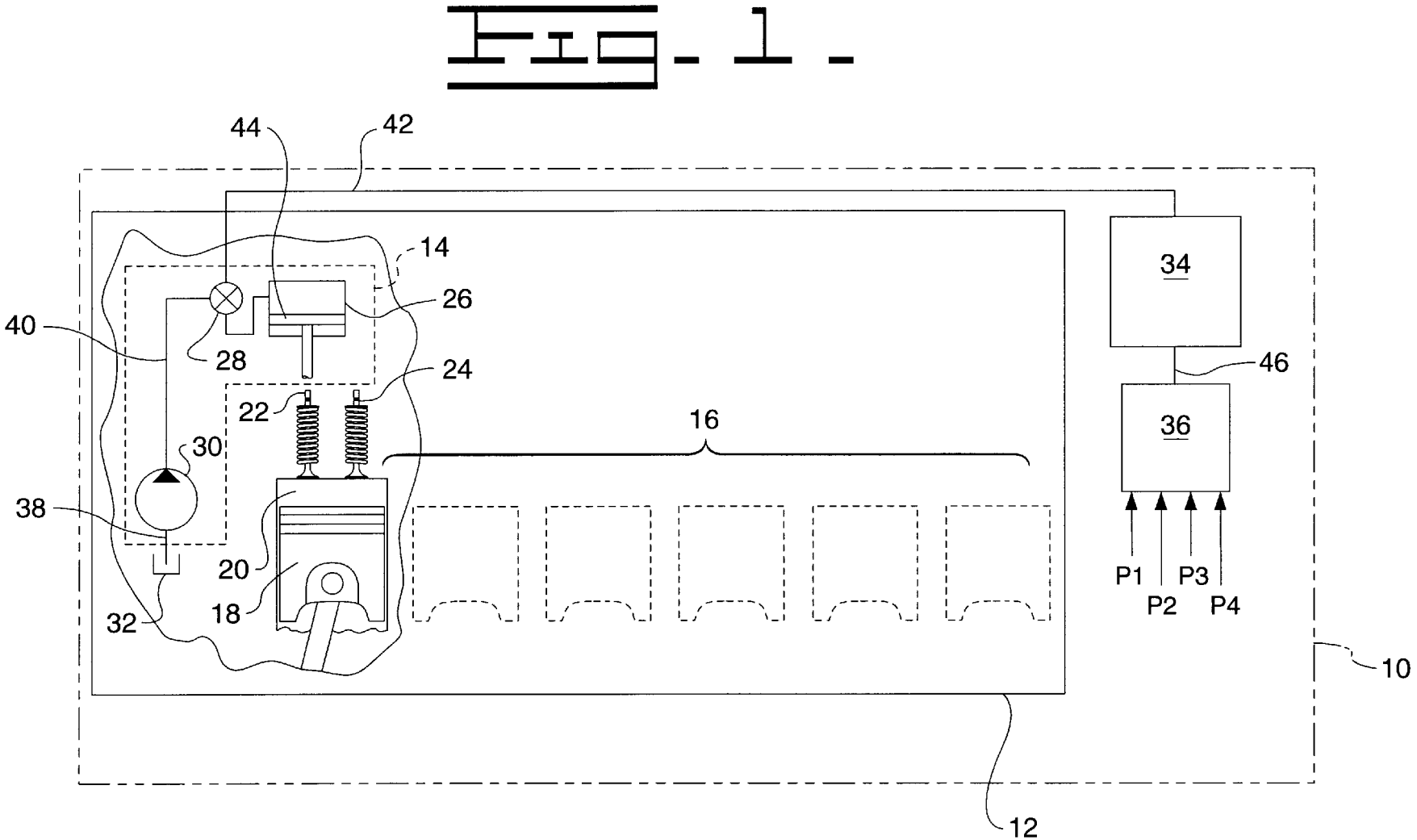
FIG. 1 is a schematic representation of a compression release brake system for an internal combustion engine in accordance with an embodiment of the present invention.

With reference to the drawings, and particularly FIG. 1, a work machine 10 having an internal combustion engine 12 equipped with a compression release brake system 14 in accordance with this invention. The work machine 10 may be an on-highway vehicle, such as a Class 6, 7 or 8 on-highway truck, or may be an off-highway vehicle, such as an earthmoving machine, material handling machine, paving machine or the like. The engine 12 is a conventional reciprocating piston engine having one or more cylinders 16 in which a piston 18 reciprocates. The illustrated engine 12 includes six cylinders, although this invention is equally applicable to engines having more or less than six cylinders.

Each cylinder 16 and corresponding piston 18 cooperate to define a combustion chamber 20 having one or more conventional intake valves 22 and exhaust valves 24. The valves 22 and 24 may be operated in several ways that are well known in the art. First, the valves 22 and 24 can be cam operated. Second, they could be operated in a "camless" manner, using electromagnetic or electrohydraulic actuators or the like. Third, a hybrid, cam and camless, method could be used in which the valves are actuated with a cam and alternative "camless" type actuators. One or more—and preferably all—of the cylinders 16 are provided with a brake actuator, generally designated 26, forming part of the engine compression release brake system 14. Each brake actuator 26 is preferably controllable to open one or more exhaust valves 24 with timing independent of engine speed. It should be noted that the system could also implement a separate, dedicated retarder valve as opposed to using one of the exhaust 24 or intake 22 valves.

As generally shown in FIG. 1, the engine compression release brake system 14 includes a brake actuator 26, an electronic control valve 28, a high pressure pump 30, and a source of hydraulic fluid 32. The pump 30 has a fluid line 38 that connects it to the low pressure source of hydraulic fluid, which is preferably lubricating fluid, such as oil, but could be a variety of other fluids including fuel or transmission fluid. The pump 30 then provides high pressure fluid, via a high pressure rail 40, to the electronic control valve 28. The valve 28 is preferably a 3-way poppet or spool valve operated by solenoid or piezo actuator but could have other configurations. The electronic control valve 28 is controlled by electronic control unit (ECU) 34. Specifically, the control valve 28 communicates with the ECU 34 via wire 42. When the electronic control valve 28 is actuated, high pressure fluid actuates a valve actuator piston 44 in the brake actuator 26 which, in turn, opens the exhaust valve 24.

Figure 2:
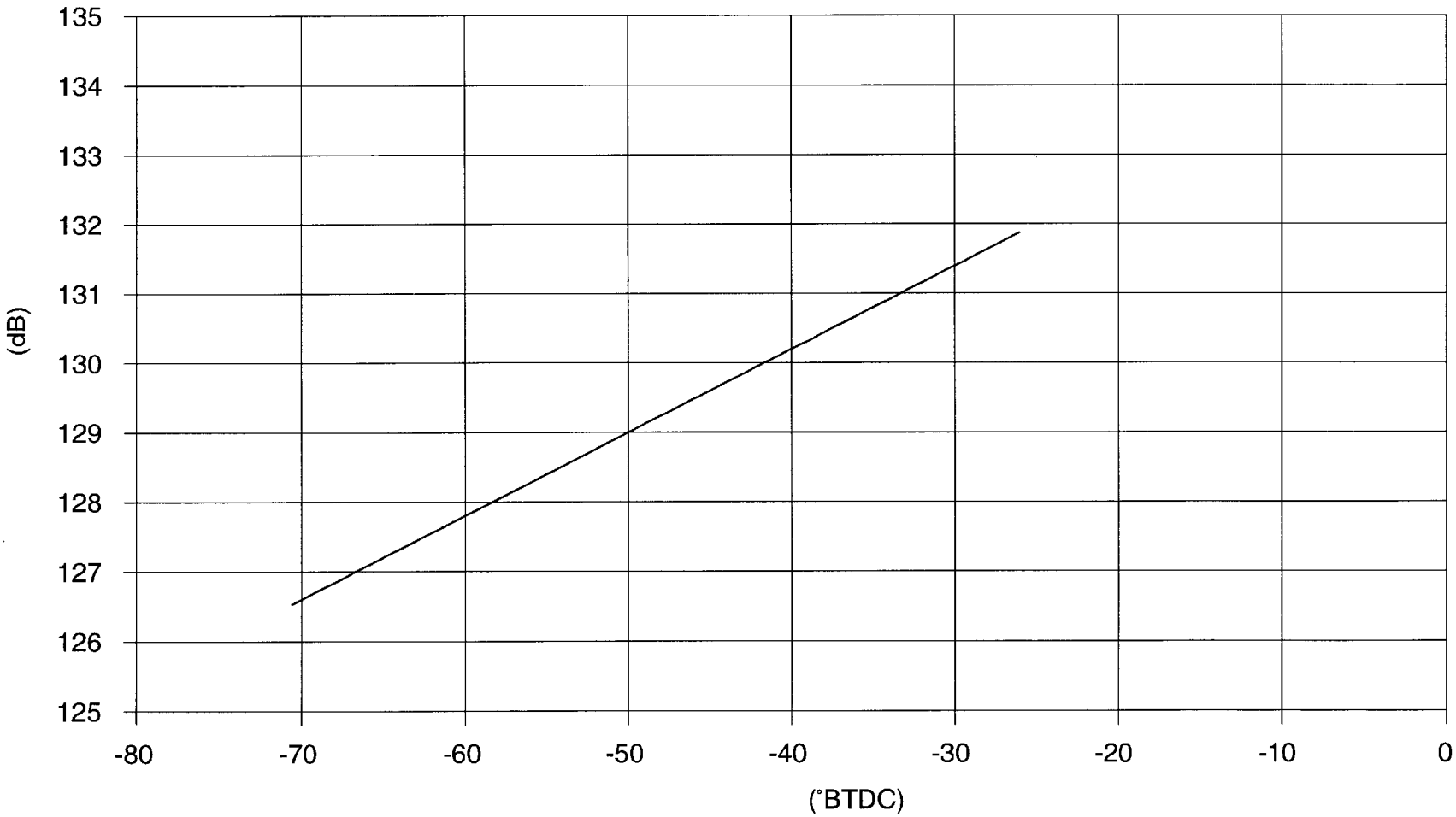
FIGS. 2 and 3 are graphs illustrating noise emission and retarding torque, respectively, based on timing of a compression release event in accordance with this invention.
Figure 3:
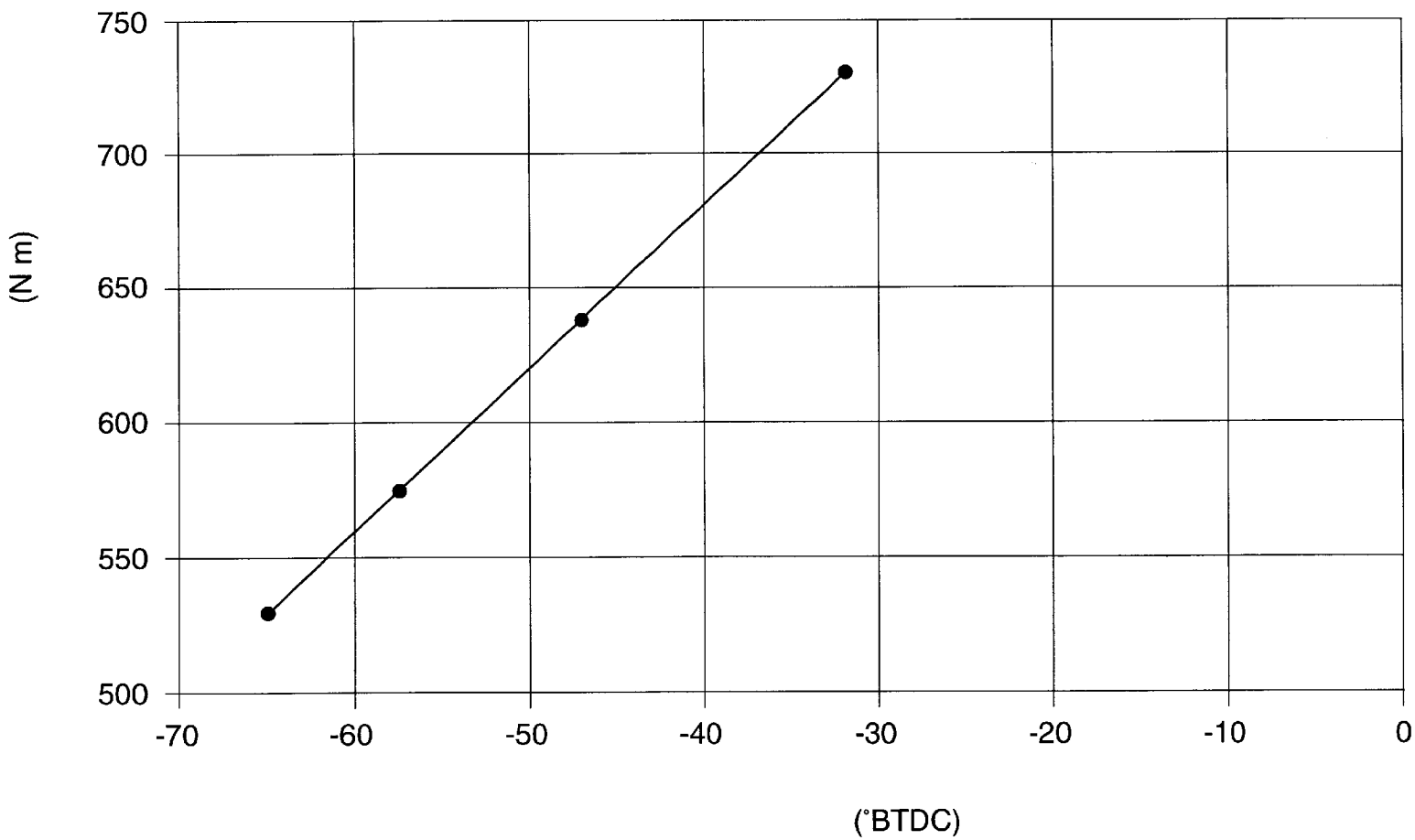

Braking is accomplished by opening a cylinder valve, usually the exhaust valve 24, when the piston 18 is near top dead center (TDC) during the compression stroke. Specifically, during the compression stroke, the piston 18 works to compress air in the combustion chamber 20. When the exhaust valve 24 is opened near TDC, the compressed air is vented or "blown down" and thus no energy is imported back into the drive train during the subsequent turnaround stroke of the piston (i.e. the normal "power stroke"). This has a retarding effect on the engine 12 as a whole, helping to slow the work machine 10. The closer the piston 18 is to TDC, the more work the piston 18 has performed before the cylinder pressure is blown down and consequently, the more braking power that is generated. Unfortunately, the closer the piston 18 is to TDC when the exhaust valve 24 is opened, the more noise emissions that are created. FIGS. 2 and 3 illustrate representative noise emissions and retarding torque based on the timing of the braking event.

When the desired braking event is accomplished, the electronic control valve 28 is deactivated, stopping high pressure fluid from acting on the brake actuator 26 and venting the high pressure fluid present in the brake actuator 26, allowing exhaust valve 24 to return to it's closed position.

The ECU 34 controls the amount of compression braking power generated by controlling the actuation of the valves. The ECU 34 can adjust the braking power by selecting the number of cylinders 16 to brake with and by adjusting the timing and magnitude of the valve events. Depending on when the ECU actuates the control valve 28, and subsequently the exhaust valve 24, various levels of braking power can be obtained with various levels of noise emissions. In particular, it is important to be able to control the braking level of the work machine 10 based upon vehicle operating conditions to provide more consistent and safer work machine 10 operation. Specifically the braking power needed varies based upon the load and speed of the work machine 10, the grade of the terrain and amount of braking requested by the operator. Additionally, by only providing the braking necessary for any given work machine operating conditions, noise emissions are better controlled.

The ECU 34 monitors work machine operating conditions and automatically adjusts the compression brake timing to provide the necessary braking power. The ECU 34 communicates with at least one sensor 36, via a sensor wire 46, to receive information that allows the ECU 34 to know the work machine operating conditions. The sensor 36 can monitor a variety of work machine operating conditions, designated p1–p4, including the work machine load and speed, the grade of the terrain, and the position of the work machine's brake pedal.

The sensor 36 can directly monitor the work machine operating conditions or can measure a related parameter and the ECU 34 can then determine the relevant work machine operating condition. Further, the sensor's sampling rate would vary upon the work machine condition being monitored. For example, speed, grade and brake pedal position would need to be monitored continually while vehicle load would need a less frequent sample rate, such as after every work machine stop.

INDUSTRIAL APPLICABILITY

With reference to the drawings and in operation, the engine compression release brake system 14 automatically controls a compression brake's braking power by monitoring vehicle operating conditions. The sensor 36 can monitor a variety of work machine operating conditions including work machine speed, load, grade and requested braking power. These conditions dictate the amount of braking power needed to slow the work machine. After sensing a work machine operating condition, the sensor 36 generates a signal based upon the sensed work machine operating condition and sends the information to the ECU 34. The ECU 34 receives the signal and adjusts the braking power between a minimum and a maximum based upon the design of the braking system and the needs of the work machine.

As stated previously, the specific structure of the compression brake system 14 can take a variety of forms as long as it is controlled by the ECU 34. The ECU 34 controls the amount, timing and magnitude of braking events thereby controlling the braking power.

Other aspects and advantages of this invention can be obtained from a study of the drawings, the disclosure and the appended claims.

LIST OF ELEMENTS

TITLE: ENGINE COMPRESSION RELEASE BRAKE SYSTEM AND METHOD FOR OPERATING THE SAME
FILE: 01-254
10 Work Machine

12 ICE
14 Compression Release Brake System
16 Cylinders
18 Piston
20 Combustion Chamber
22 Intake Valve
24 Exhaust Valve
26 Brake Actuator
28 Electronic Control Valve
30 Pump
32 Source of Hydraulic Fluid
34 ECU
36 Sensor
38 Fluid Line
40 High Pressure Rail
42 Wire
44 Valve Actuator Piston
46 Sensor Wire

What is claimed is:

1. A method for operating a work machine with an internal combustion engine compression release brake, comprising:

sensing one of the vehicle grade and weight, sensing an operating condition, delivering a signal in response to said sensed operating condition, receiving said signal, and adjusting a braking power level of the compression release brake between a minimum level and a maximum level in response to said received signal.

2. The method of claim 1 wherein said signal being proportional to said sensed operating condition and wherein the step of adjusting the braking power level of the compression release brake includes the step of increasing the braking power level in response to an increase in the magnitude of said signal.

3. The method of claim 1 wherein said signal being proportional to said sensed operating condition and wherein the step of adjusting the braking power level of the compression release brake includes the step of decreasing the braking power level in response to a decrease in the magnitude of said signal.

4. The method of claim 1 wherein said internal combustion engine has a cylinder and a valve associated with said cylinder, said valve being movable between an open position, at which compressed air in said cylinder can escape, and a closed position, at which said compressed air remains in said cylinder, and wherein the step of adjusting the braking power level of the compression release brake includes the step of varying the timing of actuation of said valve.

5. The method of claim 1 wherein said internal combustion engine has a plurality of engine cylinders and wherein the step of adjusting the braking power level of the compression release brake includes the step of varying the number of said engine cylinders used in performing compression braking.

6. The method of claim 1 wherein said internal combustion engine has a cylinder and a valve associated with said cylinder, said valve being movable between an open position, at which compressed air in said cylinder can escape, and a closed position, at which said compressed air remains in said cylinder, and wherein the step of adjusting the braking power level of the compression release brake includes the step of varying the position of said valve between the open and closed position.

7. The method of claim 1 wherein an electronic control module receives said signal and wherein adjusting the braking power level of the compression release brake includes the step of said electronic control module automatically adjusting the braking power level of the compression release brake between said minimum level and said maximum level in response to said received signal.

8. A work machine comprising:

an internal combustion engine, an internal combustion compression release brake, a sensor connected to said work machine and sensing one of a work machine's grade or weight and generating an operating condition signal in response to said sensed operating condition, and an electronic control module connected to said sensor and said engine compression release brake and receiving said operating condition signal, said electronic control module automatically delivering a braking signal based on said operating condition signal and changing a braking power level of said engine compression release brake between a minimum level and a maximum level in response to said operating condition signal.

* * * * *